United States Patent [19]

Loewe

[11] 4,095,387

[45] Jun. 20, 1978

[54] UNPLANKING DEVICE FOR UPRIGHTS OR TOWERS OF SUPPORTING SCAFFOLDINGS

[75] Inventor: Henri Loewe, Paris, France

[73] Assignee: Societe Francaise des Echafaudages Self-Lock, Aulnay-sous-Bois, France

[21] Appl. No.: 722,170

[22] Filed: Sep. 10, 1976

[30] Foreign Application Priority Data

Sep. 11, 1975 France ..... 75 27923
Apr. 13, 1976 France ..... 76 10865

[51] Int. Cl.[2] ..... E04H 12/18
[52] U.S. Cl. ..... 52/645; 52/648
[58] Field of Search ..... 52/637, 645, 648; 249/28; 248/354 P; 403/107, 108, 109, 377, 378; 182/178

[56] References Cited

U.S. PATENT DOCUMENTS 1,797,616 3/1931 Martin ..... 248/354 P X
3,604,175 9/1971 Gray ..... 52/637

FOREIGN PATENT DOCUMENTS 810,036 3/1959 United Kingdom ..... 248/354 P

*Primary Examiner*—Ernest R. Purser
*Assistant Examiner*—Carl D. Friedman

[57] ABSTRACT

The unplanking device for uprights or towers of supporting scaffoldings comprising at least two sliding elements with a pin and at least one cam slipped on said pin and rotatable respectively thereto whereby a scaffolding element pivotally supports the cam while another element bears on said cam, at least one lever being rigidly connected to the cam and locking means for the lever being designed to prevent escaping of the cam.

5 Claims, 8 Drawing Figures

UNPLANKING DEVICE FOR UPRIGHTS OR TOWERS OF SUPPORTING SCAFFOLDINGS

The present invention relates to a new unplanking device for uprights or towers of supporting scaffoldings.

It is known that supporting towers and scaffoldings for the support of plankings used for the construction of various works such as bridges, building floors and the like, must be provided with unplanking devices. These devices are designed to reduce the height of the scaffolding by a small amount and sharply when the work built in cement has set. The planking can thus be taken apart from the work and the scaffolding moved or disassembled, which of course is not possible as long as the work exerts a push on the scaffolding.

Various unplanking devices have already been described, especially craddle-stirrups placed between a sliding portion of a scaffolding upright and a stop pin, these stirrups having ramps or notches. There also exists rotating sleeves with a notch and an operating lever. These known devices are more or less satisfactory and require for their operation upon the unplanking to hit with a tool especially a sledge-hammer and, up to now, the tool has to follow a horizontal trajectory, which makes it difficult to handle. Besides the frictions in the known devices are always important because considerable friction forces are exerted on them and consequently they are very rapidly damaged.

The present invention copes with the above mentioned disadvantages.

According to the invention, the unplanking device for uprights or towers of supporting scaffoldings comprises at least two sliding elements with a pin and a cam slipped on said pin and rotatable respectively thereto whereby a scaffolding element pivotally supports the cam while another element bears on said cam, at least one lever being rigidly connected to the cam and locking means for the lever being designed to prevent escaping of the cam.

Various other features of the invention are moreover shown in the following detailed description.

An embodiment of the invention is shown by way of non-restrictive example in the accompanying drawings, wherein.

Figure 1:
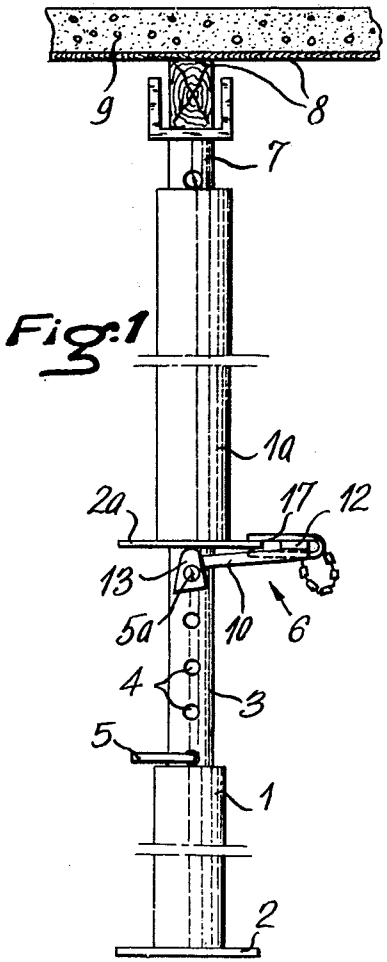
FIG. 1 is an elevation view of a supporting pole embodying the unplanking device of the invention.

Referring now to the drawings, FIG. 1 shows a supporting pole which comprises a first tubular upright portion 1 provided with a shoe 2 bearing on the ground, a tubular segment 3 bored with sets of holes 4 telescopically engaged into the upright portion 1 and held thereupon by a pin 5 passed through one of the sets of holes 4, a second tubular upright portion 1*a* provided with a shoe 2*a* slipped on the tubular segment 3 and held thereupon by the unplanking device generally designated at 6, a head-jack 7 placed at the end of the tubular portion 1*a* and a planking 8 for the support of a work 9 made of cement grouted on the planking 8.

In a known way, when the work 9 made of cement has set, the height of the above described pole must be sharply reduced to enable unplanking and also to enable disassembling the supporting pole or the supporting tower comprising various poles when such a tower is used.

Figure 2:
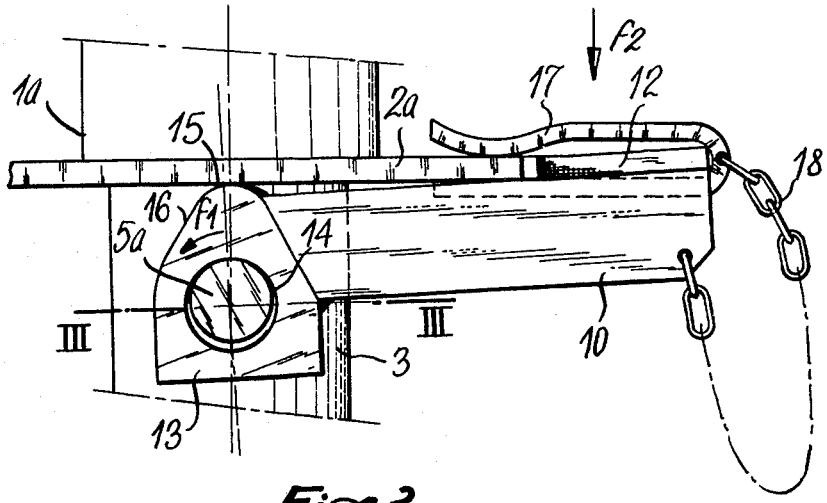
FIG. 2 is an enlarged elevation view showing the unplanking device in detail.
Figure 3:
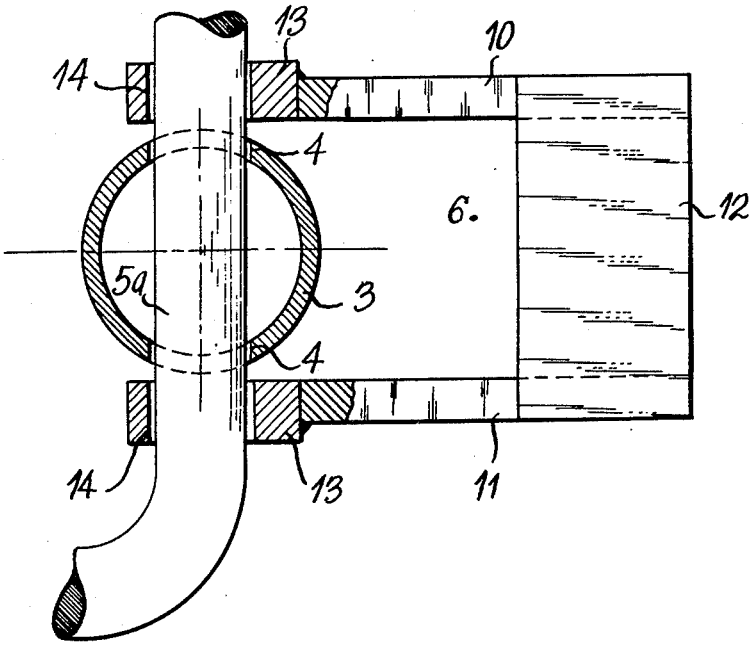
FIG. 3 is a cross section view taken substantially along line III—III of FIG. 2.

The unplanking device is essentially constituted in the embodiment of FIGS. 1 – 3, by a craddle-stirrup comprising two lever like arms 10, 11 which are connected together by an iron 12, for example a plate welded to said arms 10, 11.

At their ends, the arms 10, 11 have cams 13, similar to each other, with an aperture 14 and an arc shaped portion 15 (FIG. 2) forming the top of the cam. The arc shaped portion 15 is extended on the outer side of the cam by a downward ramp 16 with a steep slope.

FIG. 2 shows that the arc shaped portion 15 protrudes with respect to the top of the arms 10, 11.

The stirrup is held in place at any level of the tubular segment 3 by means of a pin 5*a* passed through the aperture 14 of each cam 13 and in the holes 4 of the tubular segment 3. Thus the tubular upright portion 1*a* rests on the top of the cam constituted by the arc shaped portion and, the same protruding with respect to the top of the arms 10, 11, the load applied by the tubular upright portion 1*a* has a tendency to make the cam to rotate in direction of the arrow $f_1$, consequently, to apply the arms 10, 11 against the bottom of the plate 2*a*.

For safety purposes, a grip 17 connected to the stirrup by a chain 18 covers both the plate 12 and the edge of the plate 2*a*, which eliminates any risk of accidental operation of the unplanking device.

As it appears from the above disclosure, to cause the unplanking, it suffices to remove the grip 17 and then to apply a push according to the arrow $f_2$ on the plate 12 constituting the bottom of the stirrup. The push can, for example, be provided by applying a stroke with a hammer or mallet on said plate 12 which thus constitutes an anvil. The push to be exerted is small anyway because it has only to swivel the cams 13 on a small angle. Actually, as soon as the unsteady equilibrium position of the cam 13 is overstepped, which position corresponding to that for which the centers of the aperture 14 and of the arc shaped portion 15 are lined up in a vertical plane, the force exerted on the cam by the plate 2*a* becomes sufficient to make the cams 13 sharply swivel in the direction opposite to the direction indicated by the arrow $f_1$; and consequently the plate 2*a*, the tubular portion 1*a* and the head jack 8 go sharply downward along the downward ramps 16 while the arms 10, 11 take a position substantially lined up with the axis of the corresponding segment 3, the plate 12 forming an end-of-stroke abutment.

It results from the above disclosure that the operation of the unplanking device can be easily performed by knocking on the plate 12 from top to bottom with a small hammer.

Figure 5:
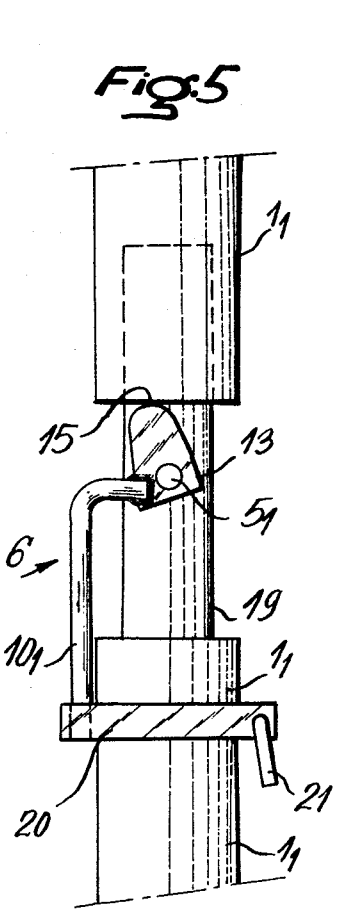
FIG. 5 is an enlarged elevation view showing one of the modified devices of FIG. 4.
Figure 4:
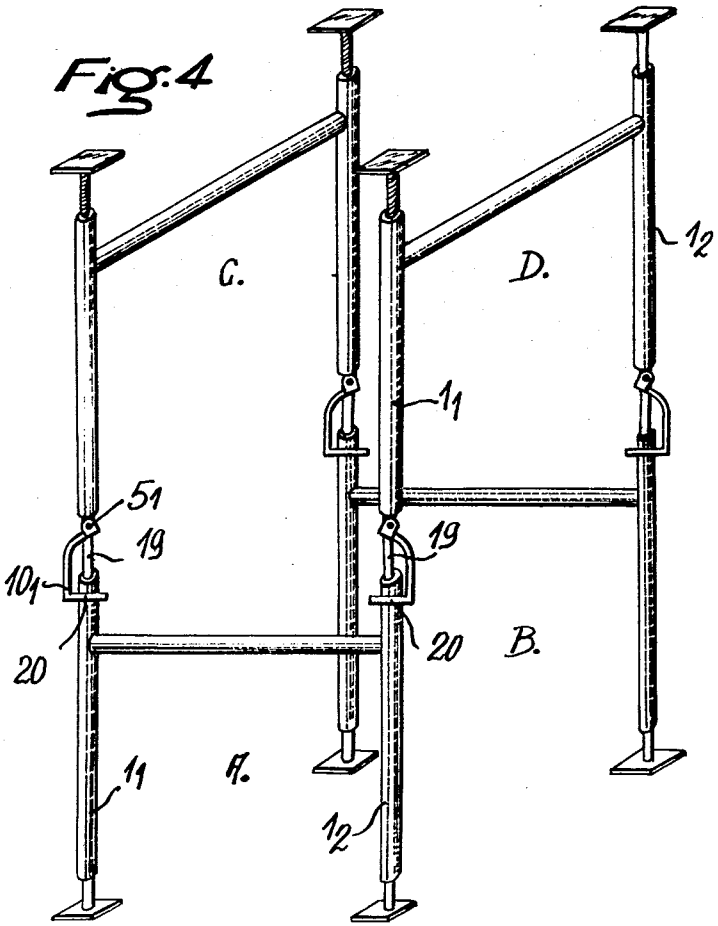
FIG. 4 is a diagrammatic perspective view of a supporting tower with the device of the invention in a modified form.

FIGS. 4 and 5 show a modification which enables to use the device of the invention when the tubular upright portions are not provided with plates 2, 2a. FIG. 4 moreover shows how the device of the invention is used when a planking is supported, no more by an upright, but by a scaffolding tower. In fact, according to FIG. 4, a scaffolding tower is constituted by assembling frames, such A, B and C, D each comprising two uprights $1_1$, $1_2$, which uprights are connected either by tubular segments as previously described with reference to FIG. 1, or by connecting parts or nipples 19 protruding from the upper portion of said uprights $1_1$, $1_2$.

As previously, the cams 13 are supported by a pin $5_1$ and the arms such as the arm 10, of the stirrup 6 are bent sustantially at right angle and are provided, at their free end, with a belt or a collar 20 instead of the plate 12, said collar being lockable by means of a pin 21 on the respective upright $1_1$, $1_2$ of each frame.

As previously, it is advantageous that the cams 13 be slightly bent when their arc shaped portions 15 bear against the lower edge of an upright because, thus, the weight applied to the scaffolding has a tendency to make the cams 13 still more to swivel by applying the collar 20 on the upright $1_1$. In this realization, the arms $10_1$ are fixed on the outer side of the cams 13, which enables, upon swivelling the cams in direction of the arrow, that the arms of the stirrup will pass on each side of the upright of the upper frame.

Figure 8:
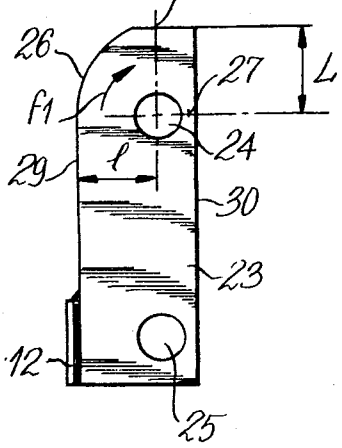
FIG. 8 is an enlarged elevation view of a detail of realization.
Figure 7:
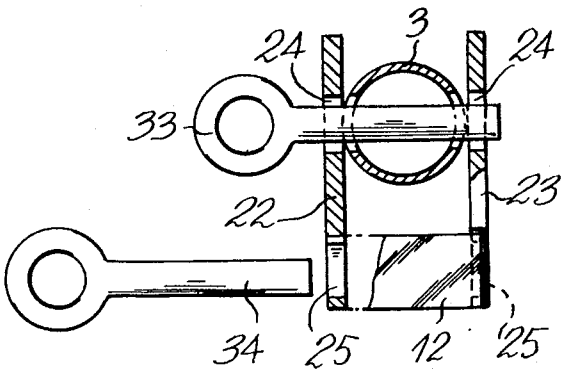
FIG. 7 is a cross sectional view taken substantially along line VII—VII of FIG. 6, the device being illustrated in a second characteristic position corresponding to the unplanking.
Figure 6:
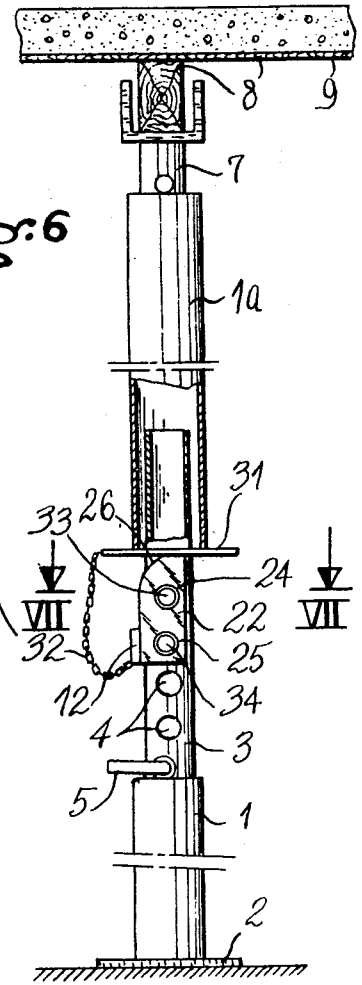
FIG. 6 is an elevation view of a supporting pole embodying the unplanking device according to a variant of embodiment.

In the realization represented in the variant of FIGS. 6 – 8, the unplanking device comprises two cams 22, 23 constituted by plate-irons connected together at one end by a plate 12, typically fixed thereto by welding. Each plate-iron 22, 23 has two holes 24, 25 spaced apart of the same distance as two successive holes 4 of the tubular segment 3.

One of the upper angles of the plate-irons 22, 23 is rounded as illustrated at 26, the center 27 of the bent part 26 being offset relative to the center of the hole 23 so that the distance L separating the axis of the hole 24 from the top 28 of each plate-iron be larger than the distance *l* separating the axis of the hole 24 of the edge 29 of each plate-iron.

As also shown in FIG. 8, the top 28 is preferably flat and extends at least from the edge 30 to the axis passing by the centers of the holes 24, 25.

The device also comprises a washer made of hard steel which is slipped onto the tubular segment 3 before placing the tubular upright 1a. Preferably, the washer 31 is connected to the plate 12 by a chain 32. The device also comprises two pins 33 and 34.

As it appears from the above disclosure, upon the construction of the stay or of the scaffolding whose successive uprights are constituted as the above described stay, the unplanking device is placed on the tubular segment 3 in the position represented in FIG. 6 by fixing it with pins 33, 34. There is then positioned the washer 31, then the tubular upright 1a, and so on.

When it is necessary to perform a center-striking or down-striking operation, the pin 34 is removed, then the plate-irons 22, 23 are swivelled in direction of the arrow $f_1$, the pin 33 forming a rotation axis for the plate-irons 22, 23. The swivelling of the unplanking device is extremely fast since a load is transmitted on the ramp 26 whose height is decreasing progressively upon the swivelling and at the end of the stroke, the center-striking which is obtained corresponds to the difference of length between the distances L and *l*. It is possible not to use the washer 31 and then it is directly the bottom of the tubular upright 1a which bears on the upper edge 28 of the plate-irons and then along the bent ramp 26 upon the unplanking.

The invention is not restricted to the embodiments shown and described in detail, for various modifications thereof can be moreover applied thereto without departing from the scope of the invention as shown in the appendant claims. Especially, the unplanking device so herein described can be placed at any place of an upright or a tower of a scaffolding since it suffices to place it at a position in which a pin can be passed, pin on which bears a portion of the scaffolding. Samely the device can, if desired, comprise only one cam and then the stirrup is reduced to one lever. In such a realization yet, a pin 5 or 33 must be provided to be lockable when engaged in one of the holes 4.

I claim:

1. A device for unplanking a scaffolding comprising:
a first upright element having a base;
a second upright element having a longitudinal axis and being provided with at least one hole extending perpendicularly to said longitudinal axis, said first upright element being adapted to receive and guide said second upright element;
two symmetrical cams placed one on each side of the second upright element, each of said cams having one aperture to register with said hole of the second upright element, said base of the first upright element bearing on said cams;
a pin passing through both said apertures and said hole, said cams being rotatable around said pin;
a lever rigidly connected to said cams; and
a locking element adapted to engage said lever and maintain said cams in a position in which said first upright element bearing on said cams biases said cams in a direction of rotation against which said locking element has an increased action, said two cams being connected by a stirrup shaped part provided with arms and forming said lever, whereby said cams cannot escape from the element bearing thereupon.

2. Device as set forth in claim 1, wherein the upper portion of each of the two cams includes an upper portion protruding above the arms of the stirrup, whereby the scaffolding element bearing on said cams exerts thereupon a pivotal force while holding the cams beyond an unsteady equilibrium position, the arms of the stirrup forming a stroke limiting abutment.

3. Device as set forth in claim 1, wherein the first upright element is provided with a platen forming said base, and the stirrup includes a bottom portion constituted by a plate in alignment with the platen of the first upright element, and a locking grip connecting said plate and said platen together.

4. Device as set forth in claim 1, wherein the arms of the stirrup are bent at right angle and are connected to an open collar cooperating with a pin for locking the stirrup when the cams to which it is connected support a scaffolding element by their upper portion.

5. A device for unplanking a scaffolding comprising:
a first upright element having a base;
a second upright element having a longitudinal axis and being provided with at least one hole extending perpendicularly to said longitudinal axis, said first upright element being adapted to receive and guide said second upright element;

at least one cam having one aperture to register with said hole of the second upright element, said base of the first upright element bearing on said cam;

a pin passing through both said aperture and said hole, said cam being rotatable around said pin;

a lever rigidly connected to said cam; and a locking element adapted to engage said lever and maintain said cam in a position in which said first upright element bearing on said cam biases said cam in a direction of rotation against which said locking element has an increased action;

wherein the first upright is provided with a platen forming said base, the lever extending substantially at a right angle to the axis of the at least one cam, whereby the arm of the lever abuts against the bottom of the platen.

* * * * *